United States Patent [19]

Carr et al.

[11] 4,080,943

[45] Mar. 28, 1978

[54] FUEL CHARGE ATOMIZING DEVICE

[76] Inventors: Virgil E. Carr, Rte. 1, Box 475, Eloy, Ariz. 85231; Delbert E. Carr, 1317 E. Willetta, Phoenix, Ariz. 85006

[21] Appl. No.: 717,848

[22] Filed: Aug. 26, 1976

[51] Int. Cl.[2] ..... F02M 29/00

[52] U.S. Cl. ..... 123/141; 48/180 S; 261/79 R

[58] Field of Search ..... 123/141; 261/78 R, 79 R; 48/180 R, 180 M, 180 S

[56] References Cited

U.S. PATENT DOCUMENTS

| | | | |
|---|---|---|---|
| 1,156,716 | 10/1915 | Shores | 48/180 S |
| 2,216,722 | 10/1940 | Denson | 123/141 X |
| 2,273,957 | 2/1942 | Harrel | 123/141 X |
| 3,283,482 | 11/1966 | Trafford et al. | 123/141 X |
| 3,447,514 | 6/1969 | Trafford | 123/141 X |
| 3,847,128 | 11/1974 | Palotsee | 123/141 |

FOREIGN PATENT DOCUMENTS

| | | | |
|---|---|---|---|
| 766,183 | 1/1957 | United Kingdom | 123/141 |

*Primary Examiner*—Charles J. Myhre
*Assistant Examiner*—Ira S. Lazarus
*Attorney, Agent, or Firm*—Charles E. Cates

[57] ABSTRACT

An atomizer disposed between the carburetor and intake manifold for breaking up and intimately mixing the charge of fuel and air received from the carburetor before passing it on to the intake manifold of an internal combustion engine. The atomizer has a chamber with two motor driven paddles with parallel axles disposed within the chamber across the air flow. The paddle vanes are overlapping in operation and geared to rotate outwardly as viewed upstream of the paddles with very high turbulence to atomize the gas particles and provide an intimate mixture of air and fuel.

8 Claims, 4 Drawing Figures

FUEL CHARGE ATOMIZING DEVICE

BACKGROUND OF THE INVENTION

The invention relates to fuel and air mixing devices for use with internal combustion engines.

The problem of mixing and atomizing the fuel-air charge coming from the carburetor for more efficient combustion in the engine has received a substantial amount of attention in the past. The prior art has a number of examples of both externally powered devices and other devices activated by the flow of the fuel-air charge from the carburetor into the intake manifold of the engine.

Illustrative of the prior art approaches and the most pertinent art known to applicant are the following U.S. Pat. Nos.: F. Assmus, 1,529,612; Raque, 1,625,281; McClenahan, 1,708,549; Brewer, 1,741,280; Kenneweg, 1,979,747; Philip, 2,061,043; Trafford, 3,447,514; and Nezat, 3,740,203.

Various objections to the prior art devices are that they are expensive, too complicated for practical operation, or the action is not vigorous enough to produce the desired degree of atomization of the fuel and its dispersion through the air in the fuel-air charge coming from the carburetor.

SUMMARY OF THE INVENTION

The atomizer is disposed operatively between the carburetor and the intake manifold of an internal combustion engine. It has a chamber having inlet and outlet ports at its upper and lower ends. In the standard arrangement where the carburetor is above the manifold the upper end of the chamber registers with the bottom flange of the standard carburetor and the bottom end of the chamber registers with the aperture of the intake manifold of the engine. The ports are sealed to the flanges by means of conventional gaskets and bolts.

Inside the chamber are two axles having radial vanes conveniently journalled in the side walls of the chamber. The axles are parallel to each other and their vanes overlap the space between the axles. They are geared to run outwardly counter to each other contrary to the intuitively correct arrangement, i.e., when viewed upstream of the vanes each vane rotates from the center of the chamber up and over to the side wall of the chamber and downwardly in the direction of the flow of the fuel charge toward the manifold. This is defined as "outer flow direction". The vanes are disposed in the chamber such that they loosely fit the interior dimensions of the chamber and the configurations of chamber and paddles are such that the paddles sweep the interior of the chamber. The paddles are driven by motor means operatively connected to the paddles by a suitable gear arrangement.

The vanes are provided with apertures, preferably elongate, with the elongate apertures of the vanes on one paddle disposed at cross angles to the vanes on the second paddle where the two overlap. The apertures preferably are covered with fine wire mesh.

Certain advantages of this invention are that the structure provided in cooperation with various elements cooperate to create a very high turbulence in the fuel-air charge, thus dispersing the gas in the air in finely divided particles. A mixing action commences immediately upon starting the motor and moving the fuel-air charge through the carburetor. The device has been found to effect a great improvement in gas mileage. The foregoing advantages are combined with simplicity of construction, operation and maintenance.

A better understanding of the invention may be had from consideration of the drawings in which.

DETAILED DESCRIPTION OF THE PREFERRED EMBODIMENT

Figure 1:
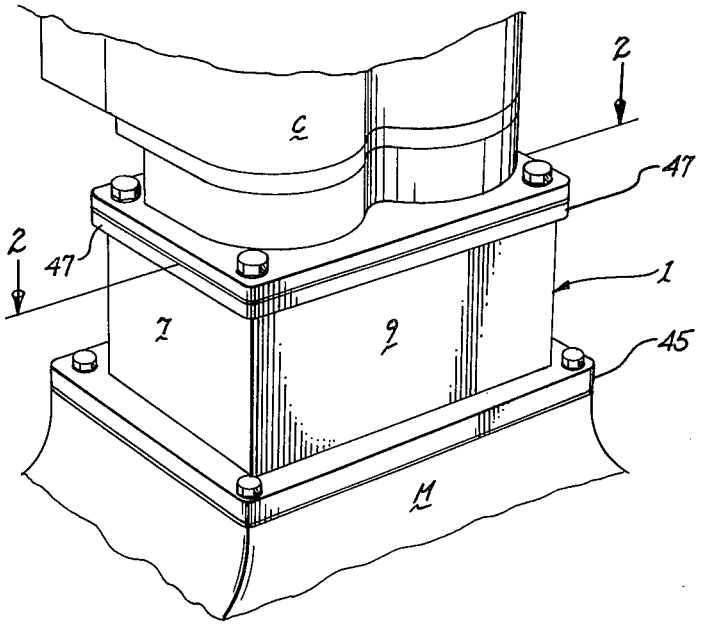
FIG. 1 is a perspective view showing the device disposed between the carburetor and manifold of an internal combustion engine.

In FIG. 1 the atomizer 1 is shown with portions of prior art elements with which it is associated, carburetor C and the manifold M.

Figure 4:
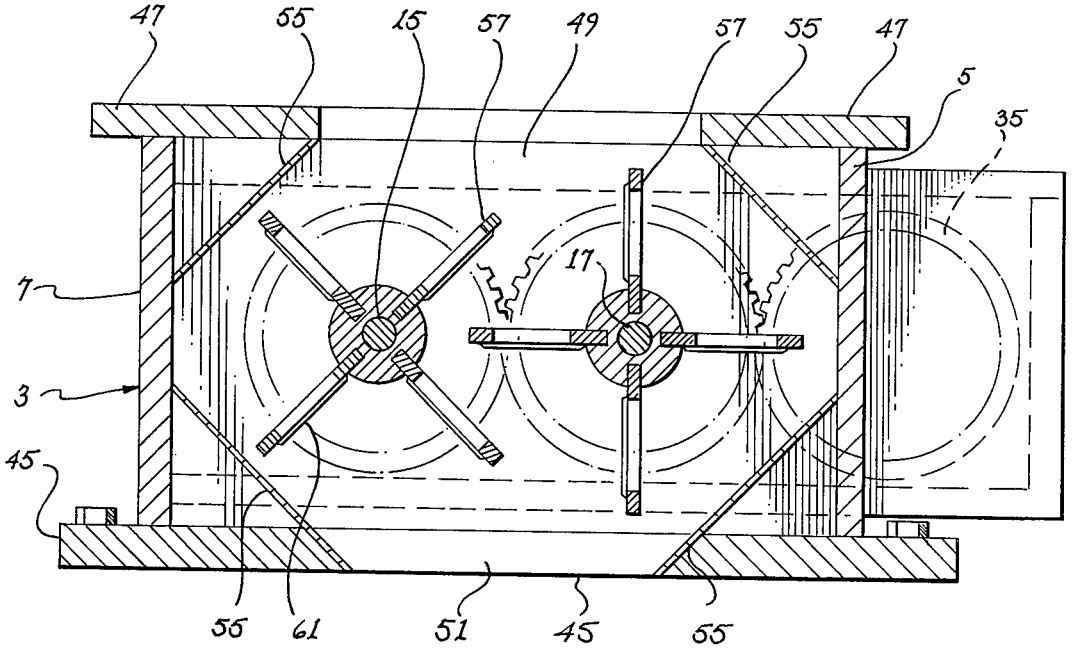
FIG. 4 is a view in section of the device of FIG. 2 taken along the lines 4—4.

The internal construction of the atomizer is shown in more detail in FIG. 4. It has a chamber generally designated as 3. Chamber 3 has two end walls 5, 7 and two side walls 9, 11. The side walls and end walls are joined to a base plate 45 and top plate 47 (FIG. 1) which respectively are provided with outlet port 51 and inlet port 49. The base plate and top plate are joined to the manifold and carburetor by the usual threaded bolt and tapped bore arrangement.

Inside the chamber 3 and attached to the end walls 5, 7 are plates 55 which constrict the chamber. Axles 15, 17 are journalled in the side walls by means of roller bearings 19, 21 disposed in side wall 9 and bearings 23, 25 disposed in side wall 11. The axles 15, 17 extend through side wall 11 terminating in spur gears 29, 31. The teeth of gear 31 mesh with the teeth of gear 35 which is mounted on the take-off shaft 37 of an electric motor 39. The gears are enclosed in a gear box generally indicated as 41.

On the axles 15, 17 are vanes 57 which loosely fit the interior of chamber 3. The vanes of axle 15 as viewed in FIG. 4 rotate clockwise and the vanes of axle 17 rotate counter clockwise; the gear 35 attached to the motor rotates clockwise. The vanes 57 have apertures 59 which in this preferred embodiment are covered by wire mesh 61.

Figure 2:
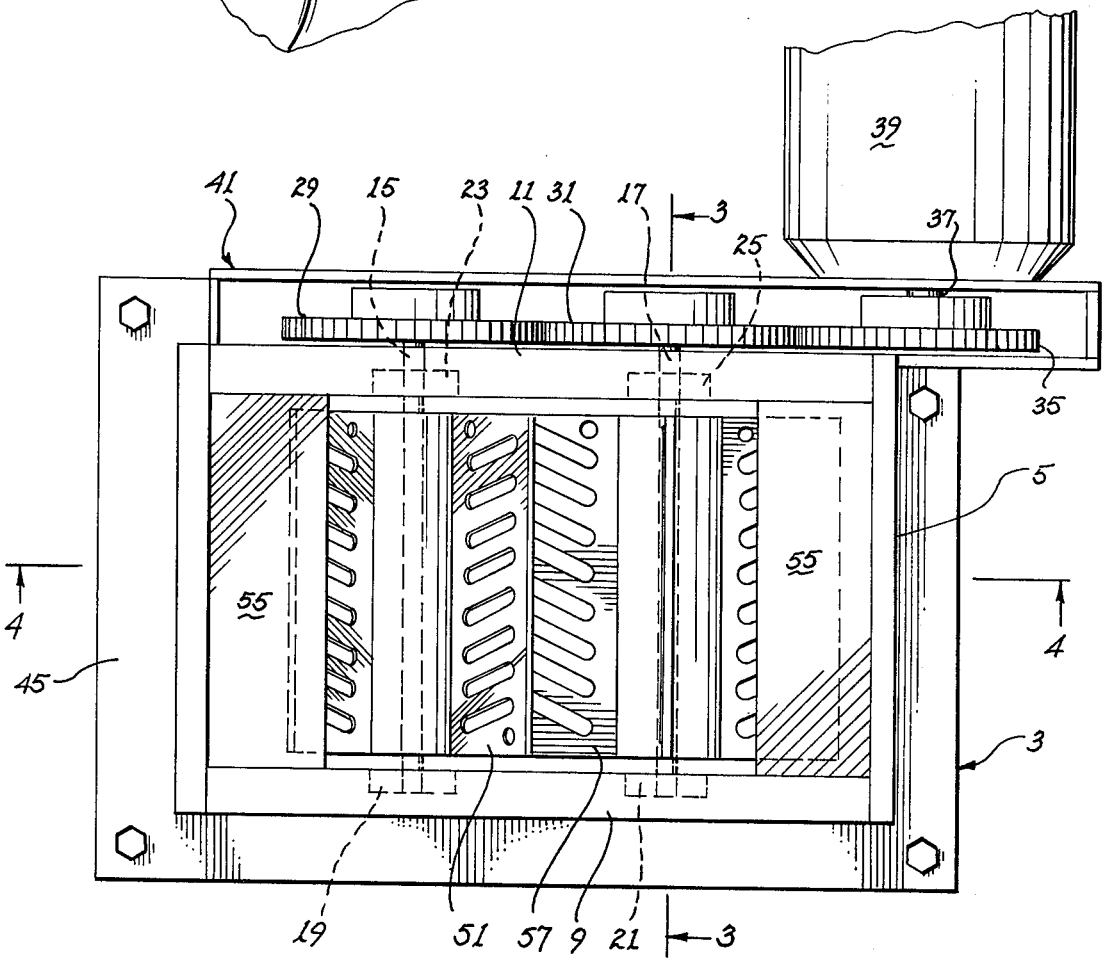
FIG. 2 is a plan view of the device of FIG. 1 along the lines 2—2 with the top end wall removed.
Figure 3:
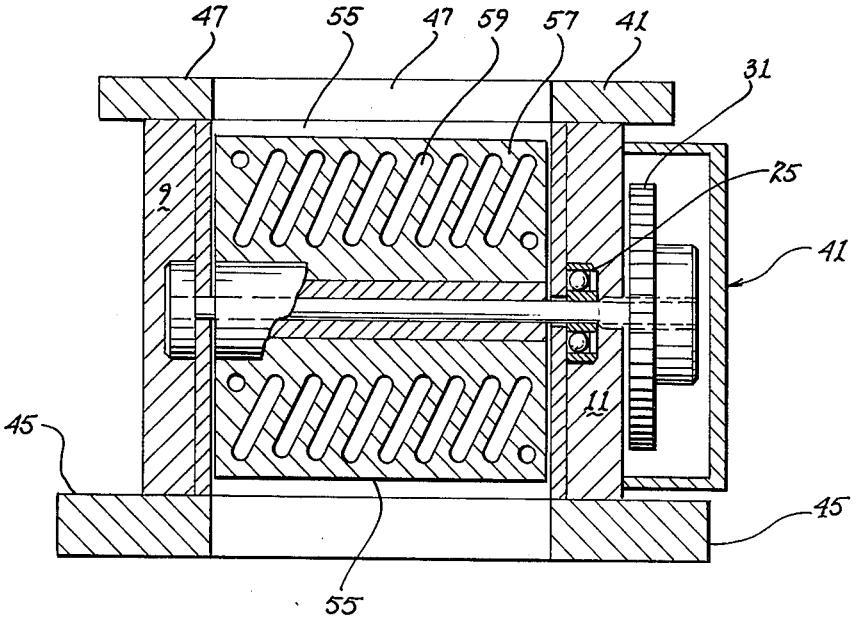
FIG. 3 is a view in section of the device of FIG. 2 taken along the lines 3—3.

As best seen in FIG. 2 the vanes 57 overlap each other in the center portion of the chamber. The apertures of the vanes on axles 15, 17 are at an angle to each other in their overlapping position.

A suitable electric circuit (not shown) including the battery and alternator, the ignition switch, motor and fuse is provided to energize the electric motor 39 when the ignition key of the automobile in which the device in incorporated is turned on. The preferred motor is a two-speed electric motor which turns at up to 1400 RPM on low and up to 3200 RPM on high. Ideally the RPM of motor 39 should be keyed to the RPM of the vehicle engine by any suitable means.

In operation, the motor 39 powers the axles 15, 17 by means of gears 35, 31 and 29. This immediately causes the vanes 57 to rotate counter to each other in outer flow direction as defined above thus creating a positive action which breaks up and directs a fuel-air charge into the manifold as soon as the ignition switch is closed. It is important that the paddles counter rotate in outer flow direction to obtain optimum efficiency. Ambient air is drawn through the air filter (not shown) into the carburetor C where it is preliminarily mixed with fuel.

The resulting fuel charge is then drawn into the atomizer 1 by the positive action of the vanes. Concommitantly the action of the overlapping vanes creates a high disturbance in the fuel-air charge drawn into the carburetor with a consequent intimate mixture of fuel and air in the charge. The atomized mixture is then forced out the atomizer 1 and into the manifold M and thence to the various cylinders of the motor.

Surprisingly efficient results in terms of fuel economy and performance have been obtained as a result of using the atomizer of this invention compared to the same properties without the atomizer or with the results which might be expected from many of the prior art devices.

The following examples illustrate the advantages which are obtainable by the use of the atomizer of this invention:

EXAMPLE ONE

A 1972 Chevelle Malibu whose odometer read 45,642.7 miles was used as a test vehicle. The vehicle was equipped with standard factory equipment plus an atomizer constructed according to the invention. It was driven at a substantially constant speed. The route covered was a round trip of 100 miles from a 50 mile portion of I-17 North of Phoenix, Ariz. A head wind of approximately 10 miles per hour became a tail wind on return. 4.2 gallons of gasoline were consumed on the run. The mileage was 23.8 miles per gallon.

A slight hesitation accompanied by a slight smell of gasoline was noticed on acceleration. The test unit was removed upon completion of the run. Gasoline was found in the bottom of the device which appeared to be the result of an incomplete seal.

EXAMPLE TWO

The test vehicle of Example One was used as the test vehicle in a second run. At that time the odometer read 45,753.4 miles. The test vehicle was equipped with standard equipment as in Example One. The test unit atomizer made according to the invention was removed. The test vehicle was driven over the same route and at about the same speed as in the test in Example One. The head wind, again cancelled by a tail wind on the return leg, was approximately 7 to 8 miles per hour. The trip consumed 8.3 gallons of gasoline. Mileage was 12.1 miles per gallon. A slight hesitation on acceleration was also noticed on this test run.

EXAMPLE THREE

The test vehicle in preceeding examples was again used; the odometer reading was 47,225.1 miles. A different adapter was made to fit the adapter to the manifold. A different manifold was used in an attempt to create a tight seal on the unit which had been noticed to be leaking in prior tests. Just prior to the test run the vehicle was provided with a new carburetor, new points and condensor, new spark plugs, wiring, oil change and filter, all of which were standard factory equipment. A measured round trip course of 100 miles was driven on I-10 South of Phoenix. There was no wind. The test run consumed 3.9 gallons of gasoline. The mileage was 25.7 miles per gallon. Again a slight hesitation was noted upon acceleration.

EXAMPLE FOUR

The test vehicle of Example Three was used in a subsequent test with the odometer reading of 47,332.7 miles. The test run was exactly the same as the test run of Example Three without the invention. There was a side wind of approximately five miles per hour. A substantially constant speed of approximately 55 miles per hour was maintained. Approximately 7.9 gallons of gasoline were consumed. The mileage was 12.6 miles per gallon.

From the foregoing examples it is seen that the instant invention provides substantially improved performance over standard automotive equipment.

It will be understood that various modifications of the invention will suggest themselves to persons skilled in the art from the teachings of this disclosure, all of which are understood to be within the spirit and scope of the invention which is to be measured by the appended claims.

What is claimed is:

1. In combination with the carburetor and intake manifold of an internal combustion engine, a fuel charge atomizer operatively disposed therebetween comprising:

(a) a chamber having an inlet and outlet port and side walls;

(b) a pair of parallel rotatable axles disposed in said chamber transversely to the flow of the fuel charge, said axles having radial vanes disposed in overlapping relationship between said axles;

(c) means for mounting said axles;

(d) means for rotating said vanes.

2. The device of claim 1 wherein the axles are journalled in the side walls.

3. The device of claim 1 wherein the means for rotating said vanes comprise an electric motor and connecting gear means.

4. The device of claim 1 wherein the chamber is four sided and the vanes loosely fit the inside dimensions thereof.

5. The device of claim 1 wherein said vanes have apertures.

6. The device of claim 5 wherein said apertures are elongate and the apertures of overlapping vanes are disposed at cross angles.

7. The device of claim 5 wherein said apertures are covered with mesh.

8. The device of claim 1 wherein said means for rotating said vanes is adapted to counter rotate said vanes in outer flow direction.

* * * * *